US007179139B2

(12) United States Patent
Yang et al.

(10) Patent No.: US 7,179,139 B2
(45) Date of Patent: Feb. 20, 2007

(54) ELECTRICAL CONNECTOR WITH IMPROVED TERMINAL BLOCK

(75) Inventors: Gong Qing Yang, Shenzhen (CN); Chang-Hsin Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/432,210

(22) Filed: May 10, 2006

(65) Prior Publication Data

US 2006/0258178 A1 Nov. 16, 2006

(30) Foreign Application Priority Data

May 10, 2005 (CN) ..... 2005 2 0071600

(51) Int. Cl.
*H01R 4/48* (2006.01)

(52) U.S. Cl. ..... 439/862; 439/22

(58) Field of Classification Search ..... 439/862, 439/22, 83, 27, 500
See application file for complete search history.

(56) References Cited

U.S. PATENT DOCUMENTS 4,834,680 A * 5/1989 Schmiedel et al. ..... 439/733.1
4,969,844 A * 11/1990 Sako et al. ..... 439/733.1
5,127,849 A * 7/1992 Karl et al. ..... 439/500
5,281,937 A * 1/1994 Young ..... 335/132
6,659,784 B1 * 12/2003 Klein et al. ..... 439/188
2004/0043663 A1 * 3/2004 Ikeda et al. ..... 439/627
2004/0121629 A1 * 6/2004 You ..... 439/66
2005/0054242 A1 * 3/2005 Hseih ..... 439/660

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector (100) comprises a terminal block (1) and a plurality of terminals (2). The terminal block (1) comprises an inner wall (11), an outer wall (12) opposite to the inner wall (11) and a plurality of receiving slots (10) defined between the inner wall (11) and the outer wall (12) for receiving terminals (2). A plurality of terminals (2) are assembled to the receiving slots (10) of the terminal block (1) and each terminal (2) has a contacting portion (21), a soldering portion (23) and a base portion (22) connecting with the contacting portion (21) and the soldering portion (23). Wherein each receiving slot (10) further defines a projecting board (101) extending from the inner wall (11), a supporting portion (103) forming on the top of the outer wall (12) and a channel (102) defined between the projecting board (101) and the supporting portion (103), the projecting board (101) and the supporting portion (103) respectively supports two sides of the base portion (22) of the terminal (2).

16 Claims, 3 Drawing Sheets

100

ELECTRICAL CONNECTOR WITH IMPROVED TERMINAL BLOCK

BACKGROUND OF THE INVENTION

1. Field of the Invention

The present invention relates to an electrical connector, and particularly to an electrical connector having an improved terminal block.

2. Description of the Prior Art

With the rapid development of the technology of wireless communication and advanced technology of electrics, electronic consuming products such as mobile phone, Personal Digital Assistant (PDA) etc., are designed to comply with miniaturization trend and multiple functions to meet with requirements of human. As a result, the requirements of elements, such as terminals and terminal block, used in such equipments are correspondingly go along with the trend of miniaturization. It will cause great difficulties in the process of assembly.

Please refer to FIG. 1, a conventional electrical connector shown therein comprises an insulative housing 1' and a plurality of terminals 2' assembled to the said insulative housing 1'. The insulative housing 1' characterized at circular shaped defines a plurality of receiving slots 10'. Each receiving slot 10' has a positioning board 11' which further defines an aperture 110'. Each terminal 2' comprises a curved contacting portion 21', a soldering portion 23', and a base portion 22' connecting with the contacting portion 21' and the soldering portion 23'. In assembly, a carrying mechanism of an auto-machine carries the terminal 2' toward the insulative housing 1' from the top of the insulative housing 1', in the meantime, a supporting rod moves toward the insulative housing 1' from the bottom of the insulative housing 1' and goes through the aperture 110'. The terminals 2' are assembled to the receiving slot 10' by means of the carrying mechanism and the supporting rod. However, the diameter of the aperture 110' is very slim, ie. 0.5 mm. It has many shortcomings in assembling the terminals 2' into the insulative housing 1'. Firstly, it is hard to make sure that the supporting rod goes through the slim aperture 110' exactly; Secondly, the supporting rod limited by the aperture 110' is also hard to stably support the base portion 22' of the terminal 2'.

Hence, an improved electrical connector is desired to overcome the disadvantages of the prior art.

BRIEF SUMMARY OF THE INVENTION

Therefore, a main object of the present invention is to provide an electrical connector having an improved terminal block.

To fulfill the above-mentioned object, An electrical connector comprises a terminal block and a plurality of terminals. The terminal block comprises an inner wall, an outer wall opposite to the inner wall and a plurality of receiving slots defined between the inner wall and the outer wall for receiving terminals. A plurality of terminals are assembled to the receiving slots of the terminal block and each terminal has a contacting portion, a soldering portion and a base portion connecting with the contacting portion and the soldering portion. Wherein each receiving slot further defines a projecting board extending from the inner wall, a supporting portion forming on the top of the outer wall and a channel defined between the projecting board and the supporting portion, the projecting board and the supporting portion respectively support two sides of the base portion of the terminal.

Other objects, advantages and novel features of the invention will become more apparent from the following detailed description when taken in conjunction with the accompanying drawings.

BRIEF DESCRIPTION OF THE DRAWINGS

The foregoing summary, as well as the following detailed description of the embodiments of the present invention, will be better understood when read in conjunction with the appended drawings. For the purpose of illustrating the invention, there are shown in the drawings embodiments which are presently preferred. As should be understood, however, the invention is not limited to the precise arrangements and instrumentalities shown. In the drawings.

DETAILED DESCRIPTION OF THE PREFERRED EMBODIMENT

Reference will now be made in detail to the preferred embodiment of the present invention.

Figure 1:
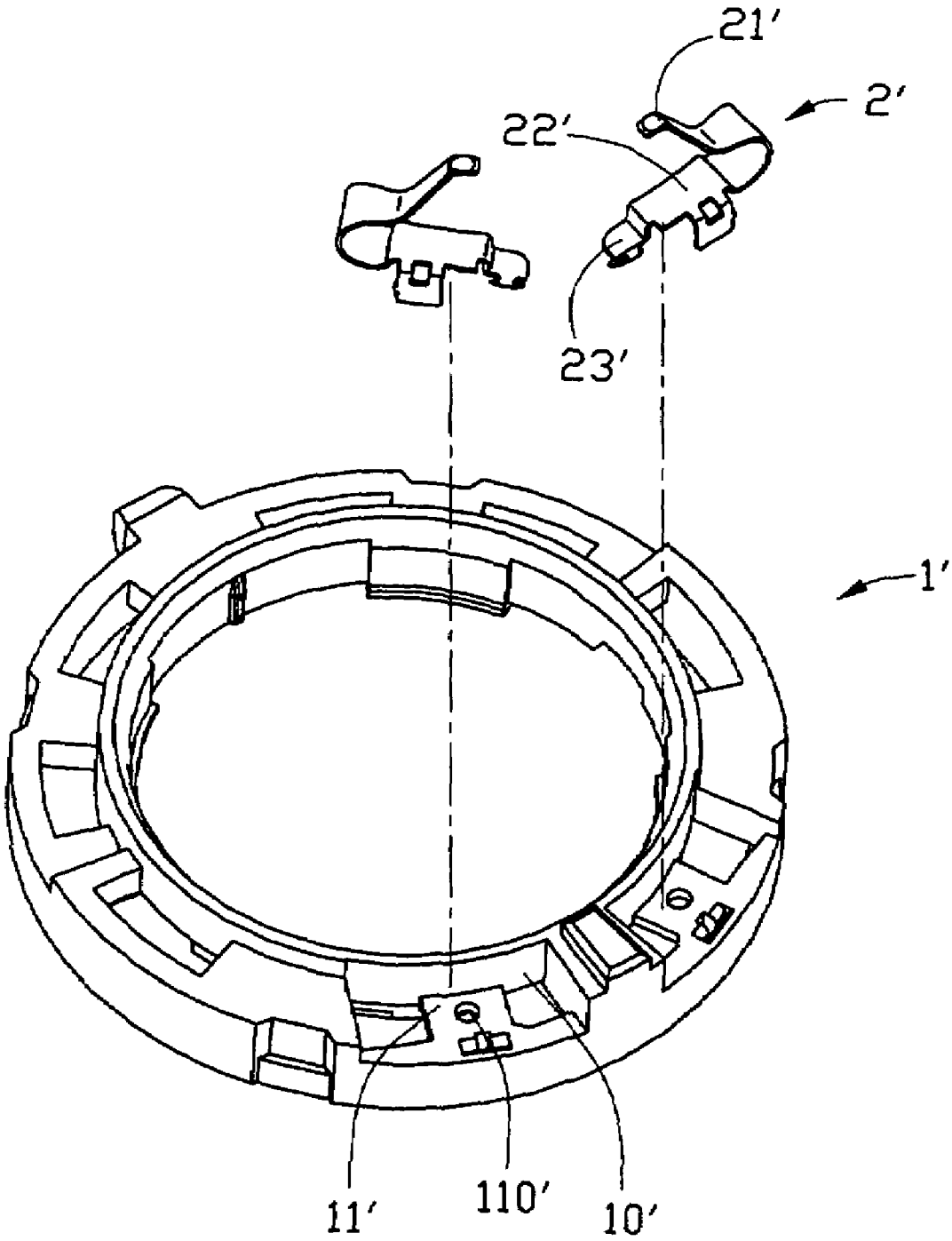
FIG. 1 (PRIOR ART)
FIG. 1 is an exploded, perspective view of a conventional electrical connector.
Figure 2:
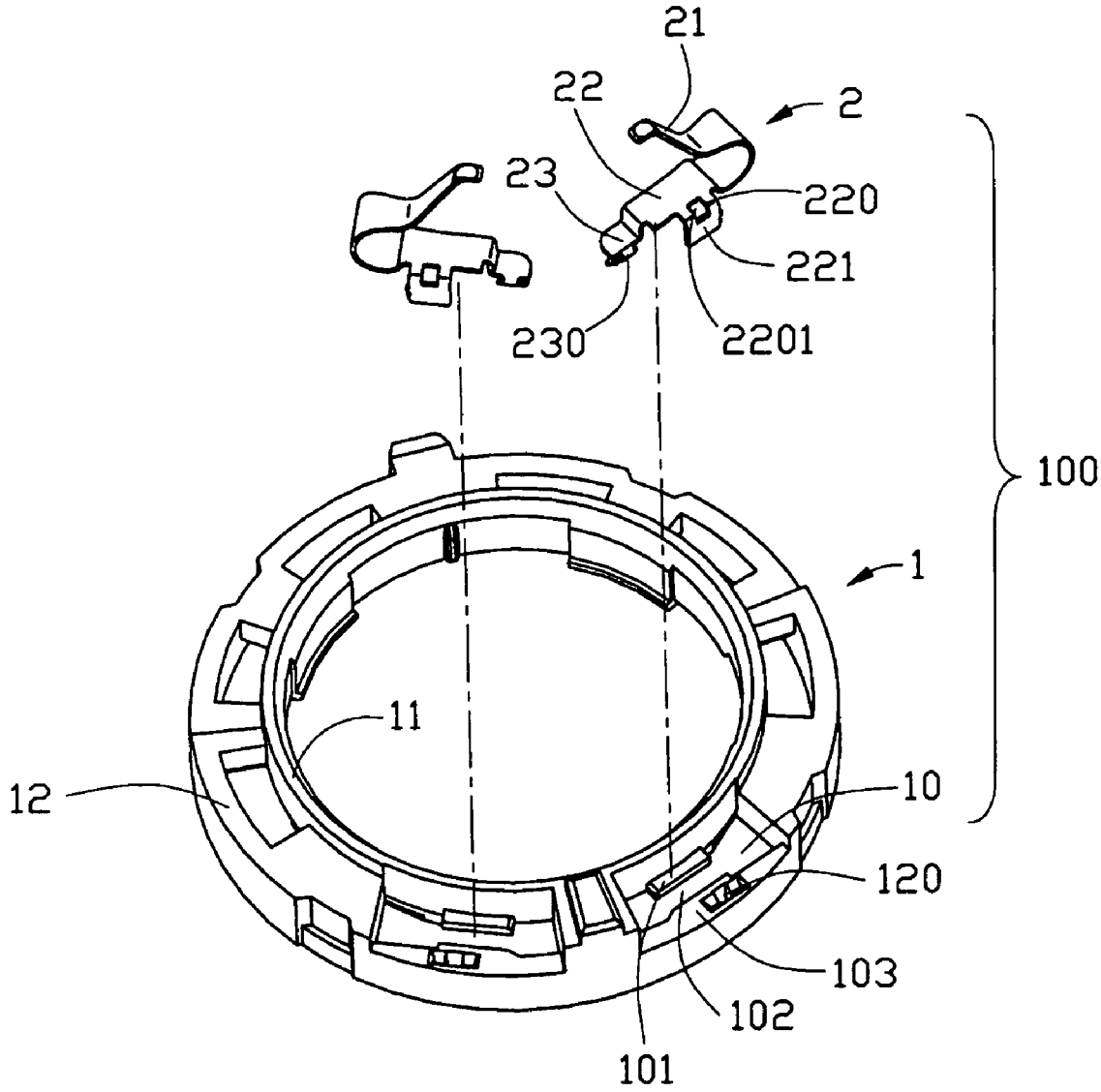
FIG. 2 is an exploded, perspective view of an electrical connector according to the present invention with two of terminals illustrated.
Figure 3:
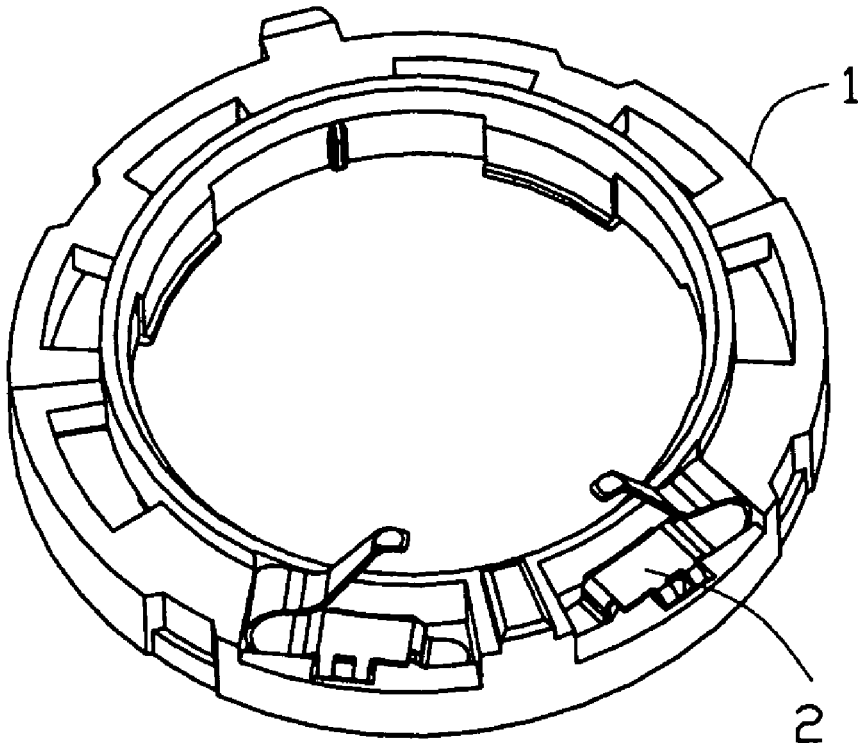
FIG. 3 is an assembled, perspective view of an electrical connector according to the present invention with two of terminals illustrated.

Referring to FIGS. 2–3, an electrical connector 100 according to the present invention comprises a terminal block 1 and a plurality of terminals 2. The electrical connector 100 according to the present invention has eight terminals 2, and each two adjacent terminal 2 are symmetrically disposed in the terminal block 1. Thus, in order to simplify the description, the preferred embodiment only describes the two adjacent terminals 2.

The terminal block 1 dimensioned to ring shape comprises an inner wall 11, an outer wall 12 opposite to the inner wall 11 and a plurality of receiving slots 10 defined between the inner wall 11 and the outer wall 12 and arranged in a circumferential direction for receiving terminals 2. Each receiving slot 10 forms a projecting board 101 horizontally extending from the inner wall 11 to the outer wall 12, a supporting portion 103 defined on the upper surface of the outer wall 12 and corresponding to the projecting board 101 and a channel 102 penetrating the terminal block 1 between the inner wall 11 and the outer wall 12. The projecting board 101 and the inner wall 11 are separated at a certain distance by the channel 102. The top surfaces of the supporting portion 103 and the projecting board 101 are substantially located in the same plane, and the supporting portion 103 further defines a retaining groove 120 corresponding to the projecting board 101.

Referring to FIG. 3, Taking the labeled terminal for description, the terminal 2 comprises a horizontal base portion 22, contacting portion 21 forwardly extending from the base portion 22 and curved backwardly and then slantwise and upwardly extending to locate above the base portion 22, a soldering portion 23 bending downwardly from the base portion 22 and then bending along the horizontal plane. The base portion 22 defines a holding portion 220 on one side thereof, a retaining portion 221 extending downwardly from the holding portion 220. The holding portion 220 further has a hatch 2201. A clamping sheet 230 is formed at distal end of the soldering portion 23 corresponding to the retaining portion 221, and slantwise and downwardly extends from the soldering portion 23 with an acute angle for clamping a cable. The clamping sheet 230 is convenient for soldering with a cable.

In assembly, referring to FIGS. 2–3, a carrying mechanism of an auto-machine (not shown) carries the holding portion 220 of the terminal 2 and moves from the top of the terminal block 1 toward the receiving slot 10 of the terminal block 1, while a supporting element of the auto-machine passes through the channel 102 from the bottom of the receiving slot 10 of the terminal block 1 to supports the base portion 22 of the terminal 2. The terminal 2 is reliably inserted into the receiving slot 10 of the terminal block 1 under the cooperation of the carrying mechanism and the supporting element. At the same time, the auto-machine drives a pressing mechanism to insert into the hatch 2201 of the holding portion 220, and then presses the retaining portion 221 into the retaining groove 120.

Referring to FIGS. 2–3, after assembly, the terminals 2 are received in the receiving slots 10 of the terminal block 1. Wherein one side of the base portion 22 of the terminal 2 is disposed on the projecting board 101 of the receiving slot 10, and another side of the base portion 22 is lied on the supporting portion 103 of the receiving slot 10. The contacting portion 21 of the terminal 2 projects above the upper surface of the terminal block 1 for elastically engaging with a print circuit board. The soldering portion 23 is adjacent to the bottom of the terminal block 1 and clamps a cable by the clamping sheet 230, and further solders with the cable.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a terminal block comprising an inner wall, an outer wall opposite to the inner wall and a plurality of receiving slots defined between the inner wall and the outer wall for receiving terminals;

a plurality of terminals assembled to the receiving slots of the terminal block and each terminal having a contacting portion, a soldering portion and a base portion connecting with the contacting portion and the soldering portion; and wherein each said receiving slot further defines a projecting board extending from the inner wall, a supporting portion forming on the top of the outer wall and a channel defined between the projecting board and the supporting portion, said projecting board and said supporting portion respectively support two sides of the base portion of the terminal.

2. The electrical connector as described in claim 1, wherein said projecting board is substantially coplanar with the supporting portion.

3. The electrical connector as claimed in claim 1, wherein said base portion further defines a holding portion extending from one side thereof.

4. The electrical connector as claimed in claim 1, wherein said contacting portion elastically projects above the terminal block.

5. The electrical connector as claimed in claim 3, wherein said holding portion provides a retaining portion extending downwardly from thereof, said outer wall of the terminal block defines a retaining groove corresponding to the receiving slot, and said retaining groove interferentially engages with said retaining portion.

6. The electrical connector as described in claim 1, wherein said terminal block is of ring shape, and said receiving slots are spaced arranged along a circumferential direction.

7. The electrical connector as claimed in claim 1, wherein said contacting portion forwardly extends from the base portion and is curved backwardly and then slantwise and upwardly extending to locate above the base portion.

8. The electrical connector as claimed in claim 1, wherein said soldering portion bends downwardly from the base portion and then bends along the horizontal plane.

9. The electrical connector as claimed in claim 8, wherein a clamping sheet is formed at distal end of said soldering portion corresponding to the retaining portion, and slantwise and downwardly extends from said soldering portion with an acute angle.

10. The electrical connector as claimed in claim 1, wherein each two adjacent terminals are symmetrically located in the terminal block.

11. An electrical connector comprising:

an insulative housing a receiving slot communicating with an exterior in both upward and downward directions, said slot being essentially configured with a first dimension, measured along a first direction, larger than a second dimension measured along a second direction perpendicular to the first direction;

a supporting portion and a projecting board being spaced from each other in said second direction and extending from corresponding opposing walls of said housing into said receiving slot with a gap therebetween in said receiving slot; and a conductive terminal defining a base portion having two lateral sides respectively seated upon the supporting portion and the projecting board, a soldering portion extending outwardly from one of two opposite longitudinal ends of the base portion along said first direction, and a resilient contacting portion extending outwardly from the other of said two opposite longitudinal ends; wherein said gap is dimensioned large enough to allow a tool having a sufficient cross-sectional area to upwardly engage an underside of the base portion during downwardly assembling the terminal into the receiving slot.

12. The electrical connector as claimed in claim 11, wherein said terminal further defines a retention device extending from one of said two lateral sides to engage the supporting portion.

13. The electrical connector as claimed in claim 11, wherein said contacting portion essentially extends upwardly while the soldering portion essentially extends downwardly.

14. The electrical connector as claimed in claim 11, wherein the base portion is higher than said soldering portion and said contacting portion around corresponding junctures thereof.

15. An electrical connector comprising:

an insulative housing defining a receiving slot therein, said receiving slot extending essentially in a first direction and fully exposed to an exterior both upwardly and downwardly except around a middle portion where opposite projecting board and supporting portion extending from corresponding walls toward each other in a second direction perpendicular to said first direction with a gap therebetween in said second direction; and a conductive terminal downwardly assembled to the receiving slot, said terminal including a planar base portion with two lateral sides respectively seated upon the projecting board and the supporting portion, a soldering portion extending from one of opposite longitudinal ends of the base portion, and a contacting portion extending from the other of said opposite longitudinal ends; wherein the base portion is higher than said soldering portion and said contacting portion around corresponding junctures thereof.

16. The electrical connector as claimed in claim 15, wherein said terminal further defines a retention device extending from one of said two lateral sides to engage the supporting portion.

* * * * *